US009166327B2

(12) United States Patent
Yu

(10) Patent No.: US 9,166,327 B2
(45) Date of Patent: Oct. 20, 2015

(54) CIRCUIT BOARD CONNECTOR SYSTEM

(71) Applicant: Scott S. Yu, Tiburon, CA (US)

(72) Inventor: Scott S. Yu, Tiburon, CA (US)

(73) Assignee: Vode Lighting LLC, Sonoma, CA (US)

( * ) Notice: Subject to any disclaimer, the term of this patent is extended or adjusted under 35 U.S.C. 154(b) by 25 days.

(21) Appl. No.: 13/940,853

(22) Filed: Jul. 12, 2013

(65) Prior Publication Data

US 2014/0017945 A1 Jan. 16, 2014

Related U.S. Application Data

(60) Provisional application No. 61/671,031, filed on Jul. 12, 2012.

(51) Int. Cl.

| | |
|---|---|
| ***H01R 12/00*** | (2006.01) |
| ***H01R 13/46*** | (2006.01) |
| ***H01R 43/18*** | (2006.01) |
| ***H01R 12/73*** | (2011.01) |
| ***H01R 13/04*** | (2006.01) |
| ***H01R 24/84*** | (2011.01) |
| ***H01R 31/06*** | (2006.01) |

(52) U.S. Cl.

CPC ..... *H01R 13/46* (2013.01); *H01R 9/096* (2013.01); *H01R 12/732* (2013.01); *H01R 13/04* (2013.01); *H01R 24/84* (2013.01); *H01R 31/06* (2013.01); *H01R 43/18* (2013.01); *Y10T 29/49147* (2015.01)

(58) Field of Classification Search

CPC ..... H01R 9/096
USPC ..... 439/638, 65, 66
See application file for complete search history.

(56) References Cited

U.S. PATENT DOCUMENTS

| | | | | | |
|---|---|---|---|---|---|
| 4,703,394 | A * | 10/1987 | Petit et al. | ..... | 361/790 |
| 5,641,294 | A * | 6/1997 | Beard | ..... | 439/247 |
| 5,761,050 | A * | 6/1998 | Archer | ..... | 361/791 |
| 6,079,986 | A * | 6/2000 | Beshears | ..... | 439/63 |
| 7,874,845 | B1 * | 1/2011 | Tang et al. | ..... | 439/65 |
| 8,764,490 | B2 * | 7/2014 | Watanabe et al. | ..... | 439/638 |
| 2013/0005190 | A1 * | 1/2013 | Blanchfield et al. | ..... | 439/630 |

* cited by examiner

*Primary Examiner* — Chandrika Prasad
(74) *Attorney, Agent, or Firm* — Antero & Tormey; Peter Tormey

(57) ABSTRACT

An inline connector is coupled to a first substrate and operable to receive at least one prong. A second receptacle is coupled to a second substrate and operable to receive the prong. A plug having an elongated prong that, when inserted through the first receptacle and into the second receptacle operates to provide electrical connections between the substrates. The substrates may be circuit boards and the receptacle may be mounted along the edges of the circuit board to allow for easier installation. Some embodiments may provide for identical receptacle providing for lower costs and easier installation.

9 Claims, 2 Drawing Sheets

Prior Art

CIRCUIT BOARD CONNECTOR SYSTEM

PRIORITY

This application claims the benefit of co-pending provisional patent application 61/671,031 entitled "Inline Connector System," filed on Jul. 12, 2012 by the same inventor which is incorporated into this document by reference as if fully set forth herein.

BACKGROUND

The present invention relates generally to lighting systems, and more particularly to a modularized fixture system for providing easy to install and affordable lights, power and communications media in certain environments.

SUMMARY

Disclosed herein is an inline connector coupled to a first substrate and operable to receive at least one prong. A second receptacle is coupled to a second substrate and operable to receive the prong. A plug having an elongated prong that, when inserted through the first receptacle and into the second receptacle operates to provide electrical connections between the substrates. The substrates may be circuit boards and the receptacle may be mounted along the edges of the circuit board to allow for easier installation. Some embodiments may provide for identical receptacle providing for lower costs and easier installation.

The construction and method of operation of the invention, however, together with additional objectives and advantages thereof will be best understood from the following description of specific embodiments when read in connection with the accompanying drawings

DESCRIPTION

Figure 1:
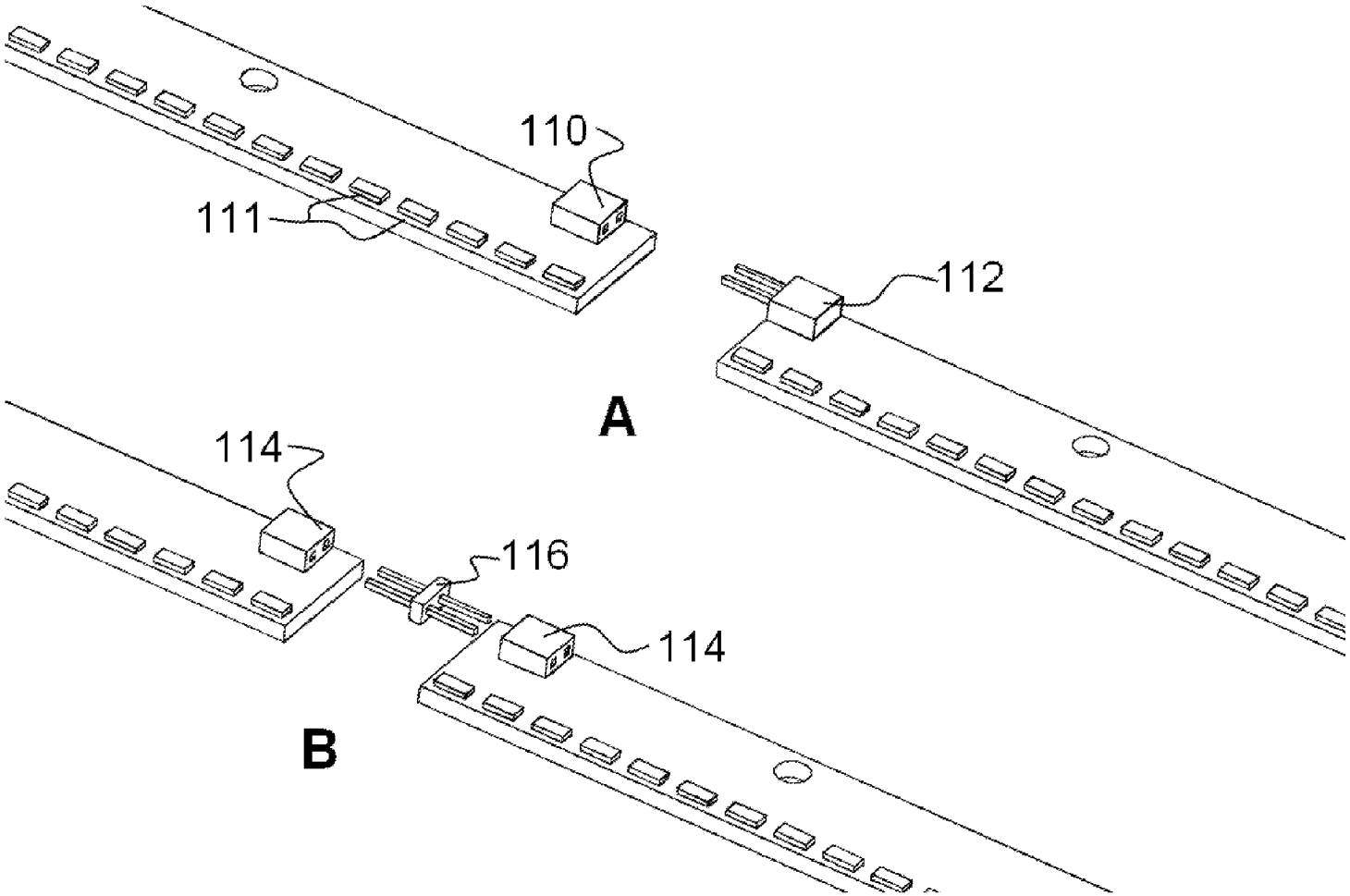
FIG. 1A shows a conventional circuit board mating scheme.
FIG. 1B also shows an alternative means for coupling boards.

Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

DETAIL DESCRIPTION

FIG. 1A shows a conventional circuit board mating scheme. In FIG. 1 two circuit boards (or substrates) are electrically coupled together using complementary connectors. A female male connector 110, mounted on a first circuit board couples to a male connector 112 mounted on a second circuit board. Conventionally traces on the circuit board provide signals to the connectors, which are in turn, passed to the mating circuit board through electrical coupling. In FIG. 1, light sources 111 such as LEDs are mounted on the circuit board and the connectors may carry power to the light sources 111.

Often mating connectors are used to supply power to multiple circuit boards connected in series. The drawback to the conventional methods is that circuit boards then require different parts to operate together. Some uses may provide for symmetrical circuit boards, but these circuit boards must then be installed in a certain direction to maintain any required polarity on the electrical coupling. Moreover, circuit boards often have conformal coatings as protection against moisture, dust, chemicals, and temperature extremes that, if uncoated (non-protected), could result in damage or failure of the electronics to function. These conformal coatings also coat the electrical connections. Accordingly, these coatings require special masking to keep the connectors clear of any material that would hamper electrical conductivity.

FIG. 1B shows an alternative means for coupling boards. In FIG. 1B each circuit board is made with the same type of connector 114 (shown as female). The electrical coupling is effectuated through a coupler 116 which has a dual male structure. In operation the coupler is placed between the two female connectors 114 as the two circuit boards are put into position. The action of joining the two circuit boards allows the male prongs on the coupler 116 to insert into the female connectors 114 and provide for transmission of electrical power or signals.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to affect such feature, structure or characteristic in connection with other embodiments whether or not explicitly described. Parts of the description are presented using terminology commonly employed by those of ordinary skill in the art to convey the substance of their work to others of ordinary skill in the art.

FIG. 2A shows an inline connector system. In FIG. 2A female connectors 214 are mounted on respective substrates or circuit boards 218. The connectors 214 are designed for receiving prongs through receptacles on the connectors 214. The connectors 214 may have electrical contacts to the circuit boards 218 allowing the connectors 214 to be soldered in place and provide electrical contact from the receptacles to the circuit board 218. A header connector (or plug) 220 has elongated prongs or members. In operation the prongs of the header connector 220 are inserted into and through a first female connector 214 and into a second female connector 214, thus providing electrical conductivity between the two circuit boards 218. Different embodiments may employ different number and type of prongs to effect coupling the circuit boards 218. For example and without limitation, an embodiment may include power connectors and one or more digital signal connectors. The prongs on the header connector 220 may be match to standardized connectors such as Ethernet or USB connectors.

FIG. 2B shows an embodiment of the current disclosure for use with an LED luminaire. FIG. 2B includes circuit boards 222 and 224 with female connectors 226 and 228 respectively. The circuit boards 222 and 224 include multiple light sources such as LEDs (shown as 230). The LEDs 230 may be powered by a constant current source (not shown) through traces on the circuit boards 222 and 224. The traces extend to the female connectors 226 and 228. One having skill in the art will appreciate that there is no need to limit this disclosure to only two circuit boards as shown, or to limit the power source in any way. Moreover, many circuit boards maybe coupled including ones using different light sources, occupancy sensors, control, communications electronics, and the like. One having skill in the art will appreciated that multiple prongs may be separated using a dielectric spacer to hold them apart.

In operation the circuit board 222 and 224 are place near each other such that the connectors 226 and 228 align. The header connector 232 is inserted such that the prongs extend into the first connector 228 and then further extend into the second connector 226. In the event a conformal coating is use and it blocks the connectors' 226 and 228 electrical contacts, then the prongs on the header connector 232 operate to break the conformal coating and reach the electrical contacts inside the connectors 226 and 228. In certain embodiments the prongs of the header connector 232 may also provide structural support for the circuit board if the prongs are made with sufficient strength.

Figure 2:
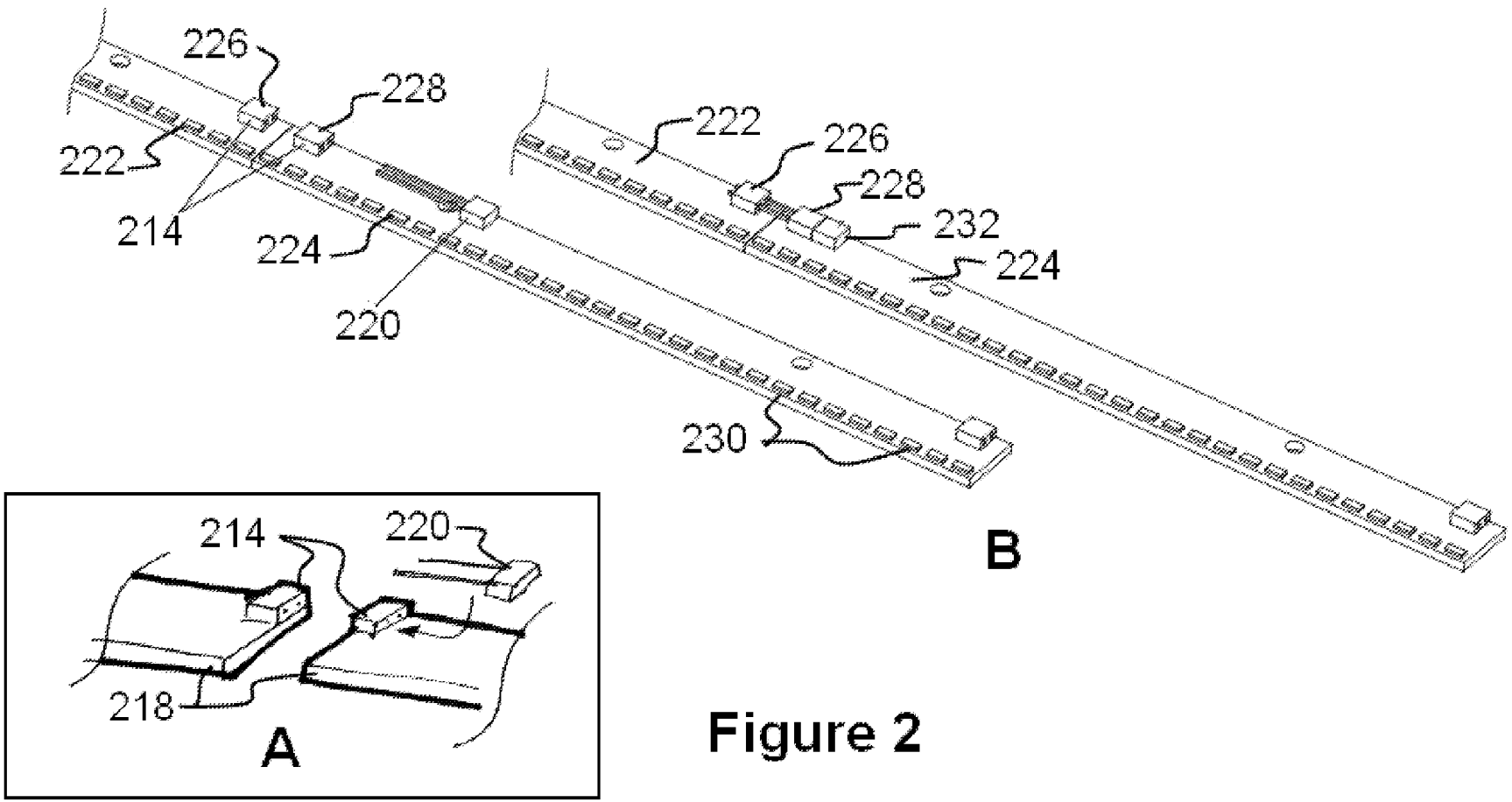
FIG. 2A shows an inline connector system.
FIG. 2B shows an embodiment of the current disclosure for use with an LED luminaire.

The embodiment of FIG. 2 provides several advantages over conventional connectors. These advantages include, but are not limited to:

Uniformity of circuit board design because all the connectors on the circuit board are the same;

Compatibility with conformal coatings;

Ease of installation because the circuit board may simply be positioned together without having to match male or female connectors;

Ease of maintenance because a single circuit board located within a series may be removed by removing the header connector.

The above illustration provides many different embodiments or embodiments for implementing different features of the invention. Specific embodiments of components and processes are described to help clarify the invention. These are, of course, merely embodiments and are not intended to limit the invention from that described in the claims.

Although the invention is illustrated and described herein as embodied in one or more specific examples, it is nevertheless not intended to be limited to the details shown, since various modifications and structural changes may be made therein without departing from the spirit of the invention and within the scope and range of equivalents of the claims.

What is claimed:

1. A device including:

a first receptacle disposed on a first substrate, said first receptacle including a through-hole extending from a first surface of the first receptacle to a second surface of the first receptacle;

a second receptacle disposed on a second substrate, said second receptacle including a receiver portion;

a connector, said connector including an insulated portion said insulating portion formed to encapsulate one end of a prong said prong extending from one surface of the insulated portion, wherein the prong is slidably disposed completely through the through-hole and at least partially disposed into the receiver portion such that the insulated portion abuts the first surface of the first receptacle and is not interposed between the first receptacle and the second receptacle.

2. The device of claim 1 wherein the prong is electrically conductive and operates to provide electrical conductivity from the first receptacle to the second receptacle.

3. The device of claim 1 wherein the first receptacle is disposed along an edge of the first substrate.

4. The device of claim 1 wherein the first substrate is a circuit board.

5. A method including:

disposing a first receptacle on a first substrate, said first receptacle including a through-hole extending from a first surface of the first receptacle to a second surface of the first receptacle disposing a second receptacle on a second substrate, said second receptacle including a receiver portion, said receiver portion disposed to abut the second surface of the first receptacle, and disposing at least one prong through the first receptacle and into the second receptacle, said prong including an insulated portion, said insulating portion enclosing an end of a conductive portion, wherein said insulated portion, abutting the first surface of the first receptacle and not interposed between the first receptacle and the second receptacle.

6. The method of claim 5 wherein the prong is electrically conductive and operates to provide electrical conductivity from the first receptacle to the second receptacle.

7. The method of claim 5 wherein the first receptacle is disposed along an edge of the first substrate.

8. The method of claim 5 wherein the first substrate is a circuit board.

9. A device including:

a first receptacle disposed substantially near an edge of a first substrate, said first receptacle including a through-hole extending from a first surface of the first receptacle to a second surface of the first receptacle;

a second receptacle disposed substantially near and edge of a second substrate, said second receptacle including a receiver portion;

a connector, said connector including an insulated portion which encapsulated one end of a prong disposed to extend from one surface of the insulated portion;

said first receptacle and said second receptacle further disposed to substantially abut and to substantially align the through-hole with the receiver portion, wherein the prong is slidably disposed completely through the through-hole and at least partially disposed into the receiver portion such that the insulated portion abuts the first surface of the first receptacle, said insulating portion not interposed between the first receptacle and the second receptacle.

* * * * *